United States Patent [19]

Piana

[11] Patent Number: 4,557,004

[45] Date of Patent: Dec. 10, 1985

[54] WATERPROOF SHOWER MODULE WITH TILE-READY INNER SURFACES

[76] Inventor: Angelo J. Piana, 8542 NW. 25th Pl., Coral Springs, Fla. 33065

[21] Appl. No.: 625,638

[22] Filed: Jun. 28, 1984

[51] Int. Cl.[4] ..... A47K 3/22

[52] U.S. Cl. ..... 4/613; 4/596; 4/612; 4/614

[58] Field of Search ..... 4/613, 614, 596, 609, 4/612; 52/35, 250, 268

[56] References Cited

U.S. PATENT DOCUMENTS

| | | | |
|---|---|---|---|
| 1,781,692 | 11/1930 | Lewis | 4/613 |
| 2,292,368 | 8/1942 | Gordon | 4/613 |
| 2,757,385 | 8/1956 | Whittick | 4/613 |
| 3,041,785 | 7/1962 | MacDonald et al. | 50/268 |
| 3,185,748 | 5/1965 | MacDonald et al. | 264/261 |
| 3,363,267 | 1/1968 | Kaiser et al. | 4/613 |
| 3,457,568 | 7/1969 | Amatruda | 4/613 |
| 3,675,384 | 7/1972 | Knecht | 52/250 |
| 3,800,335 | 4/1974 | Buonaura | 4/613 |
| 3,895,398 | 7/1975 | Mustee | 4/613 |
| 4,423,528 | 1/1984 | Wiedmeier | 4/613 |

FOREIGN PATENT DOCUMENTS

| | | | |
|---|---|---|---|
| 2707691 | 8/1978 | Fed. Rep. of Germany | 4/613 |
| 36570 | 4/1978 | Japan | 4/613 |

*Primary Examiner*—Henry K. Artis

*Attorney, Agent, or Firm*—Oltman and Flynn

[57] ABSTRACT

A prefabricated shower module with a bottom and low side walls and a slightly lower front wall which has a horizontal outward projecting lip. The bottom preferably has a gentle downwardly sloping pitch leading to a drain hole with recesses for a strainer, so that water puddles are not formed in the bottom. The inside surfaces of the bottom and the walls are roughly textured so that they are well adapted for holding ceramic tiles attached thereto by means of thinset adhesive. The upwardly-facing edges of the walls are adapted to mate with wall boards forming the inner upper walls of the shower enclosure. The use of the shower module enables a workman to readily install a shower enclosure that is both watertight and has true and plumb surfaces.

2 Claims, 2 Drawing Figures

WATERPROOF SHOWER MODULE WITH TILE-READY INNER SURFACES

BACKGROUND OF THE INVENTION

The invention relates to prefabricated shower modules and particularly to shower modules that have inner surfaces and a structure that makes it ready for receiving tiles on its inside walls.

In conventional shower installations constructed from composite sheet materials, the shower walls often suffer from unsightly and irregularly folded corners, which are difficult to cover with tiles and for attaining a satisfactory workman-like appearance.

Furthermore, at the bottom part of the shower installation, it is difficult to avoid leakage of water into the so-called "pan". This usually happens several months after installation and may require costly repairs.

With conventional methods of constructing a shower, it is usually necessary to apply a layer or bed of mortar or so-called "mud" during the final tiling of the lower part of the shower and the floor in order to provide square and level surfaces on which to install the tiles. This is a time consuming process that requires considerable skill.

Further still, with conventional shower construction, it happens that the pitch of the floor may not be satisfactory and causes the formation of puddles of water on the shower floor.

Inventors have in the past sought to overcome these problems.

U.S. Pat. No. 3,675,384 discloses a shower flooring construction having a metal angle at the bottom of the shower stall walls.

U.S. Pat. No. 3,457,568 discloses a shower receptor having a bottom wall circumscribing upright end walls with a drain opening draining over a supporting slab.

U.S. Pat. No. 3,185,748 discloses a method for fabrication of multiple unit tile assemblies.

U.S. Pat. No. 3,041,785 discloses a multiple unit ceramic tile assembly.

U.S. Pat. No. 2,292,368 discloses a vitreous enamel bath floor that provides an improved "non-slip" floor surface.

OBJECTS AND SUMMARY OF THE INVENTION

The herein disclosed invention overcomes the hereinabove stated problems by providing a prefabricated bottom part of a shower enclosure that forms a base with low side walls and a bottom having the proper pitch. Thus, the low side walls are true and plumb, and are shaped in such a way that they are prepared for installation of the complete side walls, so that the complete installation, when finished, is true, square and plumb. The bottom pan would now have properly pitched surfaces for proper drainage of the bath water.

The shower module, according to the teachings of the invention, further provides to inner surfaces an unfinished rough texture for good adhesion to ceramic tiles or marble, so that tiles and marble can be attached using so-called thinset adhesives that are quickly applied and provide adhesion between the tiles and the wall surfaces.

The shower module, as disclosed herein, is made of a waterproof, durable and relatively inexpensive material, and further provides a completely leakproof shower enclosure pan that is prepared for leakproof attachment of a drain pipe.

Further objects and advantages of this invention will be apparent from the following detailed description of presently preferred embodiments which are illustrated schematically in the accompanying drawings.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DETAILED DESCRIPTION OF THE PREFERRED EMBODIMENTS

Figure 1:
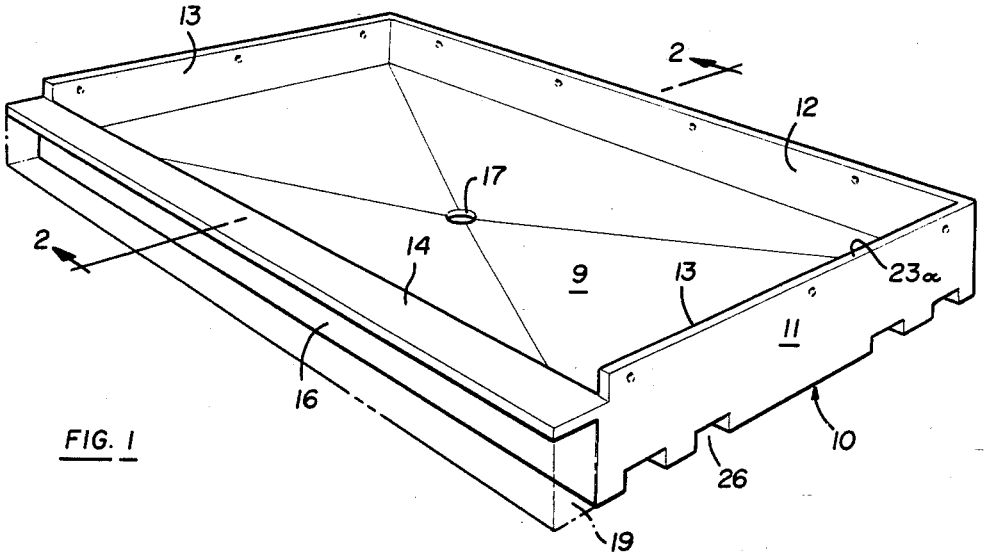
FIG. 1 is a perspective front downward-looking view of the shower module according to the invention.

In FIG. 1 the shower module 10 has a pitched floor surface 9 with a drain strainer 17 in the middle of the floor. The module has a rear wall 12 and two parallel side walls 13 and a lower front wall 16 adjoining an upper horizontal lip 14 which extends horizontally a short distance outward from the upper horizontal edge of the front wall 16.

On the underside the module has horizontal downwardly facing channels 26 serving to receive boards or slats attached to the subfloor in order to provide a firm base for the shower module.

The channels 26 are shown oriented in parallel with the front wall 16 of the module, but could alternatively be oriented perpendicular to the front wall 16, or could be provided simultaneously as two sets of channels, of which one set is oriented parallel with the front wall, and the other set is oriented perpendicular to the front wall, with the two sets of channels intersecting each other at right angles.

The module may be fabricated of any suitable waterproof, permanent material such as glass fiber reinforced plastic, known as fiber glass, as well as other materials such as cement with glass fiber fill and with admixed epoxy reinforcement or any other suitable material.

The inner surfaces of the module are left unfinished with a textured rough surface which provides good adhesion to the adhesive used for installing the tiles.

Figure 2:
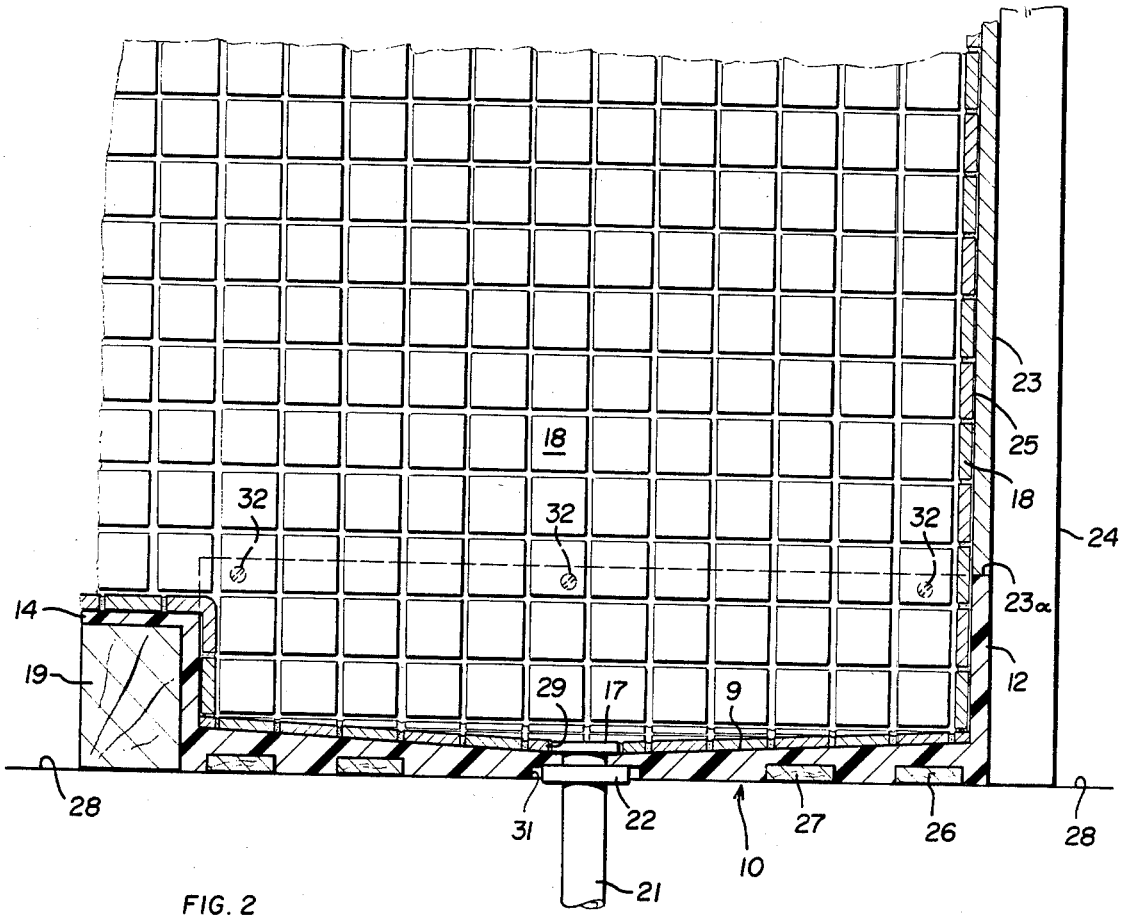
FIG. 2 is a cross-sectional side view of the shower module seen along the line 2—2 of FIG. 1 and showing a wall board in cross-section, tiles installed therein, details of a drain and a front wood curb.

In FIG. 2, which is a cross-section seen along the line 2—2 of FIG. 1, the module is seen installed on a subfloor 28 with wooden slats 27 in the channels 26 which provide a firm base for the shower module 10.

The module is shown with its rear wall 12 abutting against a vertical wall stud 24. A sheet of wall board 23, installed vertically, is attached to the narrow surface of the wall studs 24. The wall board 23 is a moisture resistant type of board commonly having a thickness of $\frac{5}{8}$".

A wire lath 25 of thin wire cloth or mesh is attached to the side of the wall board 23 facing the interior of the shower enclosure. The lath 25 serves to provide a strong connection between the wall side of ceramic tiles or marble slabs 18. The wall board 23 rests with its lower horizontal edge **23*a* on the upper horizontal edges of the walls 12 and 13 of the shower module 10**.

It follows that in order to attain a smooth, even inner wall surface of the shower enclosure, the thickness of the walls 12 and 13 of the shower module 10 should be generally the same as the thickness of the wall board 23 with the wire lath 25 attached thereto.

Installation of the ceramic tiles 18 is done by means of a suitable adhesive of the so-called thinset type, such as Miracle LMA-700, which is a water resistant latex adhesive or latapoxy 210 or any other suitable adhesive.

The floor 9 of the shower module 10 has four adjoining gently downward-sloping plane surfaces that meet at the center at the location of a drain strainer 17 which fits in a matching annular recess 29 in the floor of the shower module. The downward-sloping pitch of the floor permits water to run off into the drain strainer 17.

The strainer 17 is held in place in its recess 29 by means of a threaded nut 22 screwed into the strainer, and fits into a matching annular recess 31 in the underside of the module. A drain pipe 21 leads into the strainer, and is watertightly joined therewith. The strainer 17, the nut 22 and the drainpipe 21 all are conventional construction elements.

On the front side 16 the shower module, as stated above, has a horizontal lip 14. When installed, this lip 14 lies atop a curb 19, which may be of pressure-treated wood or of concrete, which is attached to the subfloor 28. This serves with conventionally erected sidewalls that are not shown to firmly enclose the shower module 10. The horizontal upper surface of the lip 14 serves as base for ceramic tiles which may continue into the floor surface depending on the intended construction of the surrounding structure to the shower enclosure.

The height of the lip 14 is preferably lower than the upper edges 23*a* of the shower module's side walls 13 and the end wall 12, which typically have a height of approximately 6 inches or more from the floor 9 in the shower module 10. The height of the lip 14 may typically be four inches measured from the floor 9. The lower height of the lip 14 ensures that, in case the strainer 17 should be clogged, the water in the module will not rise above the height of the lip 14, and is therefore prevented from rising to the height of the upper edges 23*a*, whereby water could leak into the space behind the walls of the shower enclosure and cause water damage there.

The module 10 may be attached to the wall studs 24 of the surrounding walls by means of screws 32, seen on FIG. 2.

A sheet metal tape, not shown, may be used to cover the joint between the walls 12 and 13 of the shower module 10 and the wall boards 12 in order to insure complete protection against water leakage.

In the foregoing description, the shower module 10, according to the teachings of the invention, provides a relatively small and inexpensive construction element which significantly enhances the ease of constructing a shower enclosure that is both waterproof and true and square, and therefore has an attractive appearance.

It follows that the shower module may not be constructed in a square or rectangular configuration, but could have a multi-sided perimeter if such had merit, and that the sides 12 and 13 need not have the same height. One side, for example, could be built higher and have a stepped profile with a bench or the like, if such a configuration were desired.

I claim:

1. For use in a building structure having:

a horizontal sub-floor;

spaced vertical studs extending up from said sub-floor and presenting inner sides to form the boundary of a shower enclosure;

vertical wallboard panels attached to the inner sides of said studs and bridging the spaces between said studs to provide the walls of the shower enclosure;

and wire lath covering said panels at the inside for the attachment of tile;

said panels having respective horizontal bottom edges spaced a predetermined distance above the sub-floor and each having a predetermined combined thickness with the wire lath along said bottom edge;

the improvement which comprises:

a one-piece shower module shaped and dimensioned to fit snugly between the sub-floor and said bottom edges of said wallboard panels;

said shower module having a floor segment for overlying engagement with the sub-floor in the area of the latter bounded by said vertical studs, said floor segment having a drain opening and a top surface sloping down to said drain opening on all sides of said opening;

and said shower module at the periphery of said floor segment having side segments extending up from said floor segment and positioned to abut against said inner sides of the studs, said side segments terminating in horizontal top edges positioned to closely underlie said bottom edges of the wallboard panels, said side segments at said top edges having a thickness equal to the combined thickness of the corresponding wallboard panels and wire lath at said bottom edges of said panels, whereby to enable tile to extend continuously across the inside of said wallboard panels and said side segments of the shower module.

2. A shower module according to claim 1 wherein:

said floor segment on the bottom has downwardly-facing parallel channels for receiving slats on the sub-floor of the building structure.

* * * * *